United States Patent [19]

Rogers

[11] Patent Number: 4,627,537

[45] **Date of Patent: * Dec. 9, 1986**

[54] LID FOR DRINKS CONTAINER

[75] Inventor: John D. Rogers, Ontario, Canada

[73] Assignee: Amhil Enterprises Ltd., Mississauga, Canada

[ * ] Notice: The portion of the term of this patent subsequent to Jan. 28, 2003 has been disclaimed.

[21] Appl. No.: 754,163

[22] Filed: Jul. 12, 1985

[30] Foreign Application Priority Data

Nov. 19, 1984 [GB] United Kingdom ..... 8429214

[51] Int. Cl.[4] ..... B65D 21/02; B65D 41/26

[52] U.S. Cl. ..... 206/501; 206/508; 220/23.83; 220/90.4; 229/7 R; 229/DIG. 5

[58] Field of Search ..... 220/90.2, 90.4, 23.83, 220/23.86; 206/508, 501; 229/7 R, DIG. 5

[56] References Cited

U.S. PATENT DOCUMENTS

| | | | |
|---|---|---|---|
| 2,003,657 | 6/1935 | Stabblefield | 220/90.4 X |
| 3,384,265 | 5/1968 | Frank | 206/508 |
| 3,557,995 | 1/1971 | Mirasol, Jr. et al. | 206/508 X |
| 3,797,696 | 3/1974 | Dibrell | 220/90.4 |
| 3,822,030 | 7/1974 | Tanzer | 229/7 S |
| 4,106,660 | 8/1978 | Boyle | 220/90.4 |
| 4,186,842 | 2/1980 | Albert | 220/90.4 X |
| 4,438,865 | 3/1984 | Scattaregia | 220/90.4 X |
| 4,441,623 | 4/1984 | Antoniak | 220/90.4 |
| 4,489,848 | 12/1984 | Braudf | 229/7 R X |
| 4,518,096 | 5/1985 | Winstead | 229/7 R X |
| 4,566,605 | 1/1986 | Rogers | 220/90.4 X |

*Primary Examiner*—Allan N. Shoap

*Attorney, Agent, or Firm*—Donald E. Hewson

[57] ABSTRACT

A vacuum-formed lid for a large drinks container is disclosed made from extruded sheet plastic. The lid has provision for the user to remove a tear-out portion to leave a hole through which liquid may be poured out of the container. The lid includes a ridge which is gripped between finger and thumb. A slit is located just under the thumb, so that squeezing the ridge is effective to open the slit. The slit runs across the "grain" of the extruded plastic. The effect is that tearing the lid can be easily accomplished, yet the tear may be directed and controlled easily.

16 Claims, 4 Drawing Figures

LID FOR DRINKS CONTAINER

This invention is in the field of drinks containers of the disposable kind. Such containers are made typically of waxed paper or polystyrene or other suitable materials.

Because of the difficulty a person experiences in carrying several drinking cups full of liquid, even when the cups have lids, it is desirable to supply the liquid in a single large container. Such a container may have its own lid, and the several (small) drinking cups may then be empty when they are being carried. Thus, by the use of a large container a person at a sporting event for example may carry drinks for several people back to his seat without difficulty. Furthermore, a vendor can dispense the liquid into the large container more quickly and more easily than into several small cups.

The invention relates to the construction of the lid for the large container. The invention is concerned only with lids made from vacuum-formed sheet plastic. (Sometimes, lids can be of injection moulded plastic, but the production processes are so widely dissimilar that the advantages and restrictions of injection-moulding are quite different).

The essential features of the invention are:

(a) that there is a ridge which can be gripped between the finger and thumb;

(b) that there is a cut or slit outside the ridged;

(c) that the cut or slit is so placed that when a finger and thumb are in place on the ridge, one of them upon pressing down into the lid, enters the cut and thereby tends to spread the cut;

(d) that the cut or slit is substantially out of line with the direction of the "grain" of the material of the lid.

The reason for this latter feture is that it is much easier to tear extruded thin sheet plastic along, rather than across, its axis of extrusion. When there is only one pre-cut slit, the slit must run across the grain, or the tear cannot be sufficiently well directed.

It is recognized in the invention, on the other hand, that one cut is all that is needed for a controllable tear, providing the said one cut does lie across the grain.

The direction of extrusion cannot usually be determined simply by a visual inspection of the lid, though occasionally streaks are visible in the plastic. However, that does not matter, because it is an easy matter to set the shearing cutters to the correct orientation with respect to the extrusion axis, since the shear cuts are made while the lid is still part of the extruded sheet. This will be explained in more detail in the specific example which follows:

In the invention, the lid is provided with a ridge, and is provided with two cuts, one each side of the ridge. When a person squeezes the sides or walls of the ridge together, the cuts start to elongate. The direction in which the cuts start to elongate then can be easily controlled by the person's finger and thumb as he squeezes the ridge. The cuts elongate towards and across the ridge, and the person can easily manipulate and finally remove a tear-out portion of the lid.

The liquid is poured out of the hole left by the tear-out portion into the drinking cups, as required. It is important that the lid retains structural strength during the pouring stage: thus, it is essential not to remove a sector of the rim of the lid, i.e., that part of the lid that snaps over the flange of the container, since that would markedly weaken the lid. In the invention, the hole does not, therefore, quite reach the rim of the lid. Hence, not quite all of the liquid can be poured out. However, when the container is almost empty, he lid can be removed at that time from the container for the purpose of pouring out the last drops.

The lid may be provided with a formed spout, to ease the act of pouring. Naturally, the spout will be a line with (i.e. at the same orientation as) the cuts.

The ridge may be arranged to surround a well that is dimensioned to accept and to grip the drinking cups. With the cups in the well, the container and the cups can be safely carried just with one hand.

In the invention, it is possible to provide two cuts, one each side of the ridge, but it is preferred that there is only one cut, and that this one cut is placed outside the ridge.

The benefit that arises from eliminating the inner shear cut is as follows. It is not possible to print elaborate directions on the lid about how the tear-out portion is to be gripped and manipulated. Also people approach the task of removing the tear-out portion with the greatest casualness. Some people place the thumb outside the ridge, and the first finger inside the ridge, and other people reverse this placement. Some people push the tear-out portion downwards into the container, while others pull the portion radially inwards.

If there are two cuts, people may sometimes tear the tear-out portion completely from the rest of the lid at a time when the tear-out portion is inside the lid. There is therefore a slight possibility that the tear-out portion could fall down inside the container.

By eliminating the inner shear-cut, it becomes more difficult for a person to tear the tear-out portion completely from the lid while the portion is inside the lid. It is however no more difficult to pull the portion radially inwards. A person therefore tends to grip the ridge between the thumb and first finger and to use the ridge as a handle to pull the tear-out portion radially inwards. When there are two cuts, one inside and one outside the ridge, the tendency is rather to push the portion through the lid down into the container.

DETAILED DESCRIPTION OF PREFERRED EMBODIMENT

Figure 2:
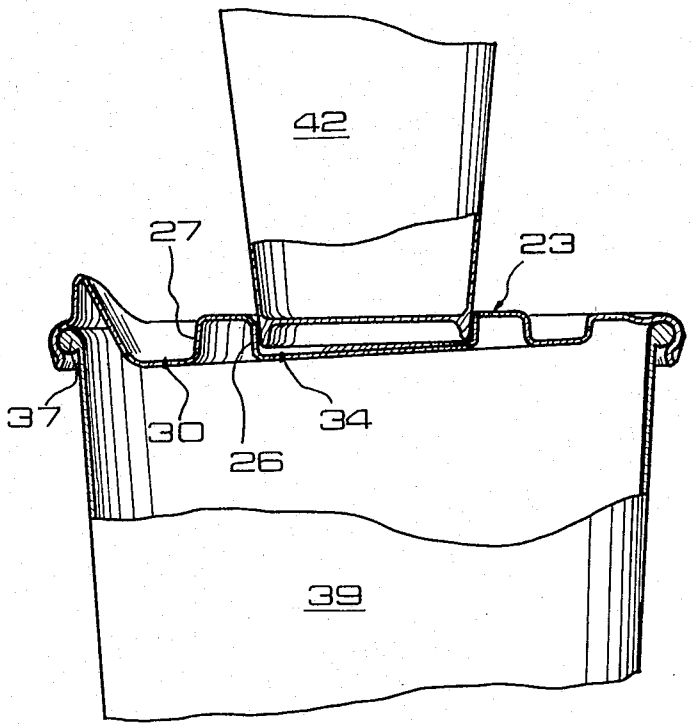
FIG. 2 is a cross section of a lid, showing the lid fitted to a container and supporting a number of drinking cups.
Figure 1:
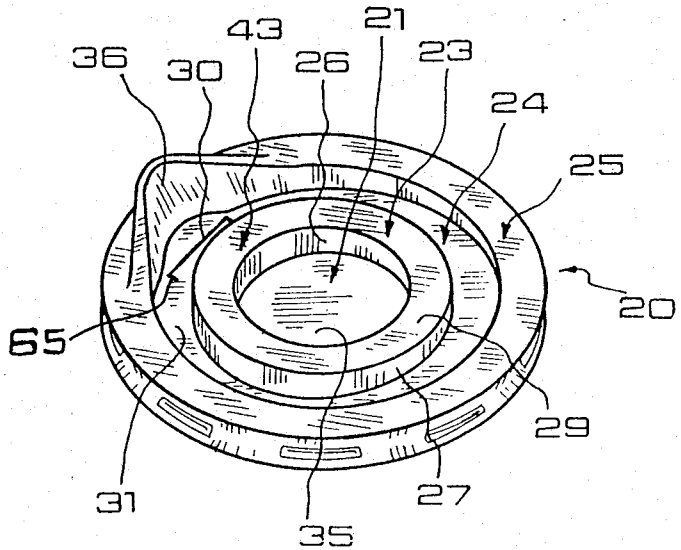
FIG. 1 is an illustrative view of a lid which has a single cut.

The lid 20 includes a well 21, a ridge 23, a trough 24, and a rim 25. All ae circular, and concentric, the ridge 23 is formed with an inner-side wall 26 and an outer side wall 27. The ridge 23 also has a top 29.

An outer cut 30 is formed in the bottom 31 of the trough 32. The cut 30 is made by a simple shearing operation. (It is a simple everyday operation to shear through a plastic lid at a place on the lid—as in the bottoms 31,35—where the plastic lies in the plane of the lid. It would be very expensive however to cut through the plastic of the side walls 26,27).

The lid 20 also is provided with a spout 36.

In use, the lid 20 is snapped over the flange 37 of a large container 39, which is made in the conventional manner from waxed paper. Drinking cups of the stacking kind, one of which 42 is shown, may be placed in the well 21. The well 21 is dimensioned so that it will grip the cup 42. Thus the assembly of container 39, lid 20, and cups 42 becomes a single unit. The unit is very much easier to carry than a quantity of separate drinking cups.

To pour the drinking liquid into the cups 42, the user removes a removable portion 43 from the lid 20. He places his forefinger and thumb one either side of the ridge 23, i.e., one inside and one outside. He then squeezes his thumb and finger together—an action which causes the walls 26,27 to move together. The action also causes the cut 30 to open.

It might be considered that only the cut 30 is important in defining the removable or tear-out portion 43. However, the ridge 23 plays an important role in controlling and defining the path along which the cut 30 will elongate.

If there were no ridge 23 at all, i.e. if the material were flat and if the person simply pushed downwards into the cut, then the cut would tend to elongate in the same direction as that of the cut itself. Thus, it would be very difficult to actually remove a portion of the lid. Even if a hole were made, a flap of the material would inevitably be left dangling inside the container. The flap would act as a valve, and would occasionally plug the hole, and generally would make pouring the liquid an uncontrolled, hazardous, operation.

It is an important feature that the ridge 23 acts as a handle, to permit the tear-out portion to be worked and manipulated, and to be finally separated and removed from the lid.

It might be considered that the function of a handle could be provided if the rib 23 were not continuous. Thus, the "handle" might be thought to possibly consist of a raised button of material radially inside the cut 30. In this case, the bottoms 31,35 of the trough 24 and the well 21 would comprise one continuous flat surface.

Even though an isolated button like that might function as a handle, the manner in which the cut 30 tends to elongate would still be largely uncontrolled. It is a feature of the invention that the ridge 23 is continuous, i.e., that the side walls 26,27 are continuous, in the region near the cut 30. When the ridge is squeezed, the cut 30 tears and elgonates in a direction which is substantially straight across the ridge. The direction in which the cut 30 elongates is defined and controlled. It becomes very easy to remove the tear-out portion 43, and to remove it without exerting a large force, and without taking more precautions than a person would expect to have to take to avoid spilling the contents of the containers.

The reason why the continuous ridge 23 is so effective may be due to a number of factors. First, the ridge 23 makes the lid 20 very rigid in the vertical direction in the region near the cut 30—much more so than in regions where the lid is simply flat. Therefore the material does not tend to bend and twist as much as it would if it were flat. This rigidity therefore enhances the controllability of the direction of tearing.

The second reason is that the walls 26,27 of the ridge are very thin. This is due to the vacuum-forming process, in which the material, prior to forming, is a flat sheet. The material tends not to slip over the forming tools. Hence, the vertical walls are comprised of stretched material, and are therefore thin. The more nearly vertical the wall, and the higher the wall, the thinner it will be. The walls 26,27 of the ridge 23 are therefore thin, and easily able to accept and continue a tear. The top 29 of the ridge 23 of course will not be stretched, but once the tears have reached the top 29 of the ridge 23, it is an easy matter finally to tear through the top 29.

The bottoms 31,35 of the trough 24 and well 21 are sloping, as may be seen in FIG. 2, so that the walls are not stretched and thinned quite so much at the orientation directly opposite the spout 36. The material that makes up the spout 36 is not thinned very much either, since it is not so nearly vertical as the walls 26,27. Thus, the thinnest part of the material of the lid 20 is in the walls 26,27, at the orientation in line with the spout 36: i.e., directly where it is required for the cut 30 to elongate.

The cut 30 is preferably straight. The tools which shear the cuts are then much easier to make than they would be if the cuts were, for example, curved. However, the outer cut 30 may be curved, so that the cut follows the line of the spout 36. The outer cut 30 might alternatively be provided with cross-cuts 65 at or near its ends, for the purpose of directing—even more controllably—the elongation of the cut 30 towards the ridge 23.

Thin sheet polystyrene, of the kind used in making lids, has the property that the material is considerably easier to tear along the "grain" of the material than across the grain.

In use, a person's finger or thumb enters the cut 30 when he grips the ridge 43. It is virtually an automatic reaction for the person to tear the lid by pulling the gripped part of the ridge towards the centre of the lid.

The torn portion can be left still attached to the lid in the form of a flap. If so, the small torn portion would not pose any additional problem. Alternatively, the torn portion may be removed completely and discarded. Whether torn away or left as a flap, the torn portion tends to be always outside, not inside, the container.

Figure 4:
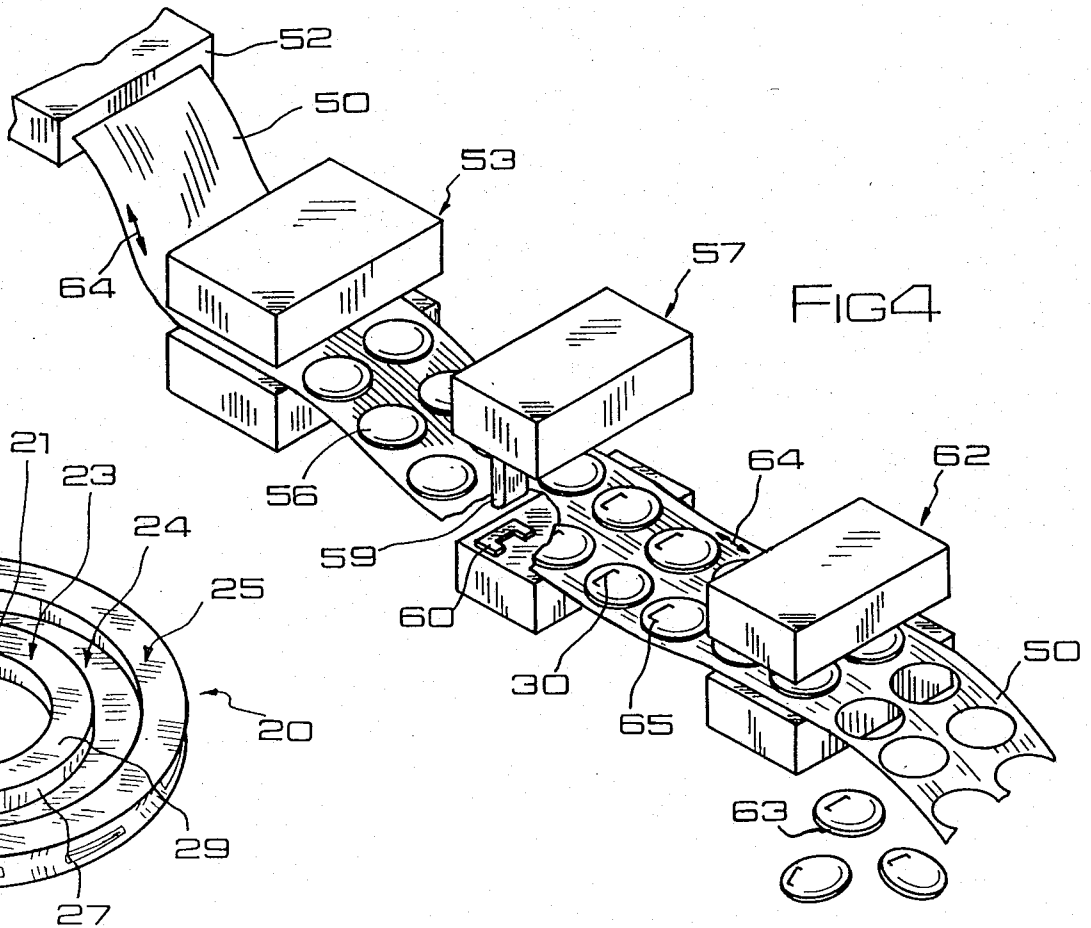
FIG. 4 shows an extruded sheet of plastic at a stage in the manufacture of vacuum-formed lids.

In FIG. 4, plastic sheet 50 passes from an extruder 52. The sheet enters a vacuum-forming station 53 where the platic is sucked onto and takes the shape of a set of die immpressions. The sheet 50 remains clamped in the station 53 for a short period to allow the sheet to set in the shape of the impressions.

The sheet 50 emerges from the vacuum station 53 with the now-formed lids 56 still attached to the shet. The sheet enters shearing station 57 which contains pairs of shear cutters 59,60. The cutters 59,60 are effective to produce the slits or cuts 30. After the shearing station the sheet passes to a blanking station 62 where the finished lids 63 are blanked out of the sheet.

The apparatus shown in FIG. 4 is merely diagrammatic, and not to scale. The width of the sheet 50 for example, would normally be wide enough to accommodate many more than two lids 56.

The extruded sheet 50 has a grain 64, parallel to the direction in which the sheet was extruded. The material is much easier to tear along the grain than across it. Therefore the lids 56 should be orientated on the sheet 50, and the cutters 59, 60 complementarily orientated so that the cuts 30 lie across the grain 64. It is preferred that the cuts 30 have small tails 65 directed along the grain, again to make sure also that the tears move easily towards the centre of the lid.

Figure 3:
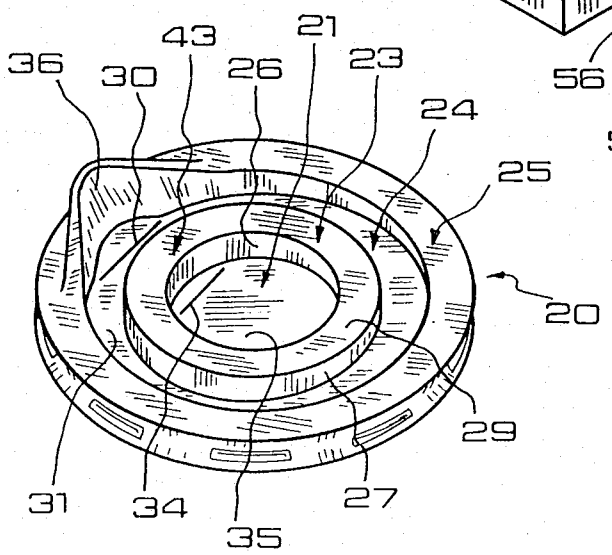
FIG. 3 is a view corresponding to FIG. 1, in which the lid has two cuts.

In FIG. 3, thee is an inner cut 34 in addition to the outer cut 30. This makes the tear pattern even more controllable, but it does mean that some people tend to push the tear-out portion 43 down into the cup 39.

The cuts 30,34 preferably should be about 2 cm long, i.e., the width of the end of a thumb. the outer wall 27 preferably varies from a height of about 7 mm at the orientation of the spout 36, to a height of about 3 mm opposite the spout 36.

I claim:

1. A circular lid for a container of liquids, which lid is vacuum formed in thin extruded sheet plastic; wherein the lid includes a depressed well, which is surrounded by a raised ridge which is in turn surrounded by a depressed trough, which is in turn surrounded by a rim, each of said well, ridge, trough and rim being substantially circular;

the bottom of the well and the top of the ridge each being flat;

the side walls and top of the ridge being of such height and radial width that a person's thumb and forefinger can be easily placed well in contact with the respective side walls, one inside and one outside the ridge;

the plane of the bottom of the well being at a small angle to the plane of the top of the ridge, such that the height of the side walls of the ridge varies around the circumference of the ridge;

there being a cut or slit in the trough outside the ridge;

the orientation at which said walls are the highest with respect to the bottom of the well being substantially coincident with the orientation at which the said cut is formed;

said cut or slit being so placed that when a finger and thumb are in place on either side of said ridge, one of said finger and thumb, upon squeezing the ridge, enters the cut or slit and thereby tends to spread the cut or slit so that liquid may be poured therethrough; and said cut or slit being out of line with the axis of extrusion or grain of the extruded sheet.

2. Lid of claim 1, wherein the cut or slit is straight and lies at right angles to a radius through its midpoint.

3. Lid of claim 1, wherein the cut or slit is supplemented by slit tails at the ends of the cut or slit, and the direction of the tails being in line with the grain.

4. Lid of claim 1, wherein the side walls and top of the ridge are continuous and extend circumferentially without interruption at least in the region of the ridge that lies along side said cut.

5. Lid of claim 1, wherein said cut is formed by a simple shearing action, there being substantially no material removed in forming the cut.

6. Lid of claim 1 wherein the sidewalls and top of the ridge are continuous and extend circumferentially without interruption completely around the circle of the ridge.

7. Lid of claim 1, wherein the well, ridge, trough, and rim are all concentric.

8. A lid as claimed in claim 1, in combination with:

a large container over which the rim of the said lid is fitted;

at least one smaller drinking cup, which is dimensioned to fit into the well of the said lid and be gripped thereby.

9. Lid of claim 1, wherein the plane of the bottom of the trough is flat and parallel to the plane of the bottom of the well.

10. Lid of claim 1, wherein the plane of the top of the rim is flat and parallel to the plane of the top of the ridge.

11. Lid of claim 1, wherein the lid is formed with a spout, at an orientation which substantially coincides with the orientation at which the cut is formed.

12. Lid of claim 1, wherein two formed cuts are provided in the material of the lid, each disposed alongside the ridge, one cut being in the well, and the other cut being in the trough.

13. Lid of claim 12, wherein the cuts are straight and parallel.

14. Lid of claim 13, wherein the cuts are straight, parallel and are both symmetrical about the same radius of the lid.

15. Lid of claim 1, in which, no cut or slit is provided in the well.

16. Lid of claim 1, wherein the cut is about 2 cm long.

* * * * *